US005086802A

United States Patent [19]

Spears

[11] Patent Number: 5,086,802

[45] Date of Patent: Feb. 11, 1992

[54] SAFETY CHECK VALVE

[76] Inventor: Harry L. Spears, 11246 TimberTech, Tomball, Tex. 77375

[21] Appl. No.: 600,671

[22] Filed: Oct. 22, 1990

[51] Int. Cl.[5] ..... E21B 17/00; E21B 33/06

[52] U.S. Cl. ..... 137/68.1; 137/498; 137/519.5; 166/84; 166/328

[58] Field of Search ..... 137/68.1, 519.5, 533.11, 137/498; 166/84, 328, 329

[56] References Cited

U.S. PATENT DOCUMENTS

| | | | |
|---|---|---|---|
| H438 | 3/1988 | Viksne | 137/533.11 X |
| 3,424,247 | 1/1969 | Lee | 166/329 |
| 4,069,840 | 1/1978 | Brown | 137/533.11 |
| 4,070,239 | 1/1978 | Bevilacqua | 137/533.11 X |
| 4,109,713 | 8/1978 | Clow | 166/84 X |
| 4,266,605 | 5/1981 | LaBorde | 166/329 |

*Primary Examiner*—Robert G. Nilson
*Attorney, Agent, or Firm*—Ben D. Tobor

[57] ABSTRACT

A safety check valve for use with a pumping unit for an oil well includes a ball housing in communication with a valve housing, a ball contained in the ball housing moving into the valve housing upon the breakage of a polished rod, whereby the ball seats upon a seating surface and seals off the oil well from the atmosphere.

4 Claims, 1 Drawing Sheet

SAFETY CHECK VALVE

FIELD OF THE INVENTION

The invention relates to a safety check valve for use with a pumping unit for petroleum fluids, the pumping unit including a polished rod and a stuffing box.

DESCRIPTION OF THE PRIOR ART

A conventional oil well which is producing petroleum fluids has a pump associated therewith to bring the petroleum fluids to the earth's surface. One type of pump conventionally employed is wedged into an internal constriction, or seating nipple, formed internally of the conventional production tubing below the petroleum fluid level. This pump is generally driven by a mechanical linkage of metal rods, generally referred to as sucker rods, which extend from the pump to the well surface. The sucker rod linkage is powered in a reciprocating motion by a conventional mechanical apparatus, or pumping unit, located at the earth's surface. The pumping unit typically includes apparatus known in the industry as a pumping jack having a horse head which is attached to a bridle, which is in turn attached to a polished rod. The polished rod is then in turn attached to the sucker rod linkage, as is well known in the art. The polished rod is reciprocated upwardly and downwardly by the horse head and bridle of the pumping unit. Typically, the oil well has at its surface a tubing head into which the production tubing is received, above which is disposed a pumping tee which has a conventional flowline associated therewith, and a conventional stuffing box is disposed above the pumping tee. The conventional stuffing box provides a sealing surface through which the polished rod reciprocates, whereby the interior of the production tubing of the oil well is sealed off from the atmosphere. Thus, petroleum fluids, as well as other fluids and gases contained within the oil well, such as salt water and hydrogen sulfide gas, cannot escape into the atmosphere.

Many pumping units are used with oil wells disposed in remote locations, the operation of the pumping unit being controlled by conventional timers or run continuously. Instances do occur when the polished rod on such a pumping unit breaks, whereby the polished rod is not disposed in a sealing relationship with the sealing surface of the stuffing box, and petroleum fluids, salt water, hydrogen sulfide gas, and other fluids and gases contained within the oil well can pass into the atmosphere through the open stuffing box. Because the pumping unit may be disposed in a remote location, and is automatically controlled by conventional timers, it may be some time before the leaking gases and fluids can be discovered, whereby the environment may be greatly damaged by the release of such unwanted gases and fluids. Such remote locations may be adjacent water sheds, creeks, rivers, lakes, and oceans, which can be polluted by the escaping fluids and gases through the open stuffing box. Alternatively, the oil well may be disposed adjacent residential areas, industrial areas, or roads and highways, all of which are being used by individuals which could suffer harmful effects from exposure to such unwanted fluids and gases, in particular hydrogen sulfide gas. Although a pumping unit which has suffered a broken polished rod adjacent such populated areas would likely be readily discovered, it would still require an unwanted passage of time before the problem could be repaired, and the well sealed off from the atmosphere.

Accordingly, prior to the development of the present invention, there has been no safety check valve, for use with a pumping unit for petroleum fluids, the pumping unit including a polished rod and a stuffing box, which: automatically seals off the interior of the well from the atmosphere should the polished rod break; and is economical to manufacture and use. Therefore, the art has sought a safety check valve, for use with a pumping unit for petroleum fluids, the pumping unit including a polished rod and a stuffing box, which: automatically prevents petroleum fluids and other gases from passing out of the stuffing box into the atmosphere; and it economical to manufacture and use.

SUMMARY OF THE INVENTION

In accordance with the present invention, the foregoing advantages have been achieved through the present safety check valve, for use with a pumping unit for petroleum fluids, the pumping unit including a polished rod and a stuffing box. The present invention includes a valve housing having upper and lower ends and a central bore extending between the upper and lower ends and adapted to have the polished rod pass through the central bore; a ball seating surface associated with the central bore; a ball; a ball housing for the ball and associated with the valve housing; and means for moving the ball from the ball housing into the central bore upon the polished rod not being disposed in the central bore, whereby the ball seats on the ball seating surface to prevent petroleum fluids from passing out of the stuffing box.

A feature of the present invention is that the means for moving the ball may include a ball receiving cavity associated with the ball housing, the ball housing having first and second ends, the first end of the ball housing being in communication with the central bore of the valve housing, the second end being closed; the ball receiving cavity having a ball support surface upon which the ball may rest, when the ball is disposed in the ball receiving cavity, the ball support surface sloping downwardly toward the first end of the ball housing, whereby if the polished rod is not disposed within the central bore of the valve housing, the ball moves down the ball support surface from the ball receiving cavity into the central bore and seats on the ball seating surface.

Another feature of the present invention is that the ball housing may have an upper surface disposed above the ball support surface and the upper surface is joined to the valve housing at a junction, the junction of the valve housing and the ball housing upper surface having a rounded configuration, whereby the ball will not be damaged if it contacts the junction. An additional feature of the present invention is that the ball seating surface may be disposed above the means for moving the ball. A further feature of the present invention is that an additional ball seating surface may be associated with the central bore of the valve housing and the additional ball seating surface may be disposed below the means for moving the ball.

The safety check valve of the present invention has the advantages of automatically sealing the interior of the well from the atmosphere upon the polished rod breaking; and is economical to manufacture and use.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
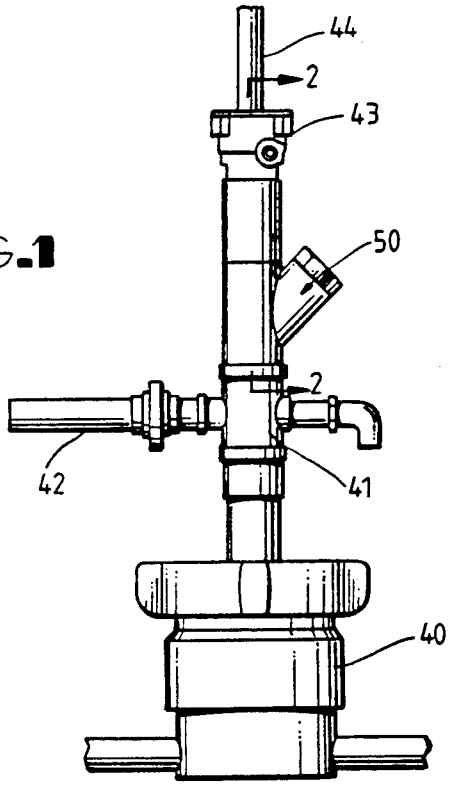
FIG. 1 is a front view of a conventional tubing head, pumping tee, flowline, polished rod, and stuffing box, provided with the safety check valve in accordance with the present invention.

In FIG. 1, certain equipment used in connection with a conventional, producing oil well is shown to generally comprise a conventional tubing head 40, pumping tee 41 having a conventional flowline 42 associated therewith, a conventional stuffing box 43, and a conventional polished rod 44 which is reciprocated through stuffing box 43 in a conventional manner, as by a pumping unit which includes a horse head and bridle (not shown) which are attached to polished rod 44, as is well known in the art. Stuffing box 43 is provided with conventional seals which, while permitting reciprocating movement of polished rod 44 within stuffing box 43, prevent the escape into the atmosphere of any petroleum fluids, salt water, hydrogen sulfide gas, or any other gas or fluid contained within the well (not shown) disposed below tubing head 40. Safety check valve 50 of the present invention is disposed between stuffing box 43, and is preferably disposed between stuffing box 43 and pumping tee 41, as shown in FIG. 1.

Figure 2:
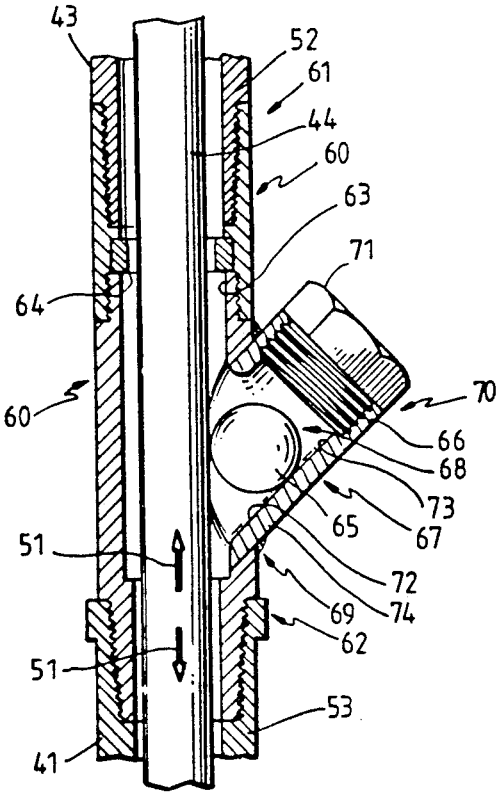
FIG. 2 is a partial cross sectional view taken along line 2—2 of FIG. 1.

With reference to FIG. 2, the reciprocating motion of polished rod 44 is illustrated by arrows 51, the lower threaded end 52 of stuffing box 43 being illustrated in FIG. 2. The upper threaded portion 53 of pumping tee 41 is also illustrated in FIG. 2, and the safety check valve 50 of the present invention is shown disposed between stuffing box 43 and pumping tee 41. If desired, a conventional valve associated with pumping tee 41 and flowline 42 permits petroleum fluids to pass through pumping tee 41 and into flowline 42 in a conventional manner. Provided polished rod 44 does not break, and the integrity of the seals within stuffing box 43 is maintained, fluids and gases contained within the oil well below tubing head 40 will not be able to accidentally, or inadvertently, escape to the atmosphere, regardless of whether or not a safety check valve 50 is utilized in connection with the conventional equipment illustrated in FIG. 1. However, if polished rod 44 breaks, as will be hereinafter described in greater detail, without the inclusion of safety check valve 50 as shown in FIGS. 1 and 2, undesired leakage of gases and fluids present within the oil well disposed below tubing head 40 can occur through the open stuffing box 43. Thus it is desirable that a safety check valve 50, in accordance with the present invention, be included, such as by being disposed between stuffing box 43 and pumping tee 41, as illustrated in FIG. 2.

Figure 3:
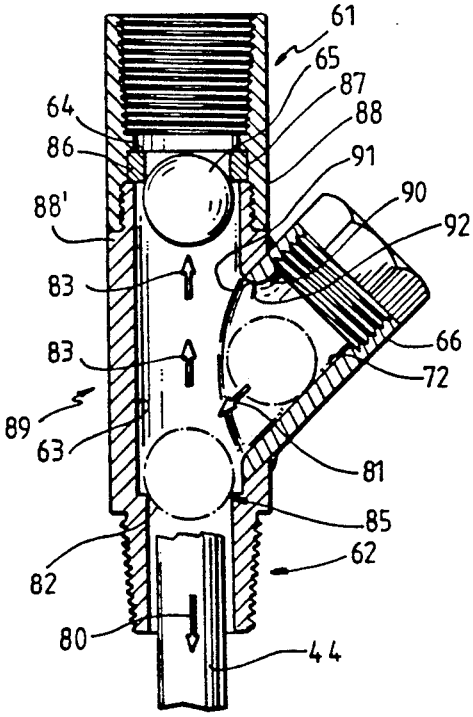
FIG. 3 is a partial cross-sectional view of the safety check valve, in accordance with the present invention, illustrating its operation after the polished rod has broken.

With reference to FIGS. 2 and 3, safety check valve 50, in accordance with the present invention, includes a valve housing 60 having upper and lower ends 61 and 62, and a central bore 63 extending between the upper and lower ends 61, 62, and valve housing 60 is adapted to have the polished rod 44 pass through the central bore 63, whereby polished rod 44 may be reciprocated in the direction of arrows 51, as previously described. Safety check valve 50 has a ball seating surface 64 associated with the central bore 63. A ball 65 is illustrated disposed within a ball housing 66, the ball housing 66 being associated with the valve housing 60. Safety check valve 50 is further provided with a means for moving 67 the ball 65 from the ball housing 66 into the central bore 63 upon the polished rod 44 not being disposed in the central bore 63.

Still with reference to FIGS. 2 and 3, the means for moving 67 ball 65 preferably includes a ball receiving cavity associated with the ball housing 66, the ball housing 66 having first and second ends 69, 70, the first end 69 of the ball housing 66 being in communication with the central bore 63 of the valve housing 60, the second end 70 of ball housing 66 being closed, as by a threaded plug 71. The ball receiving cavity 68 has a ball support surface 72 upon which the ball 65 may rest, when the ball 65 is disposed in the ball receiving cavity 68. The ball support surface 72 preferably slopes downwardly toward the first end 69 of the ball housing 66. Preferably, ball support surface 72 is formed by the lower surface 73 of a tubular member 74 which forms ball housing 66. When polished rod 44 is properly operating and disposed in the position illustrated in FIG. 2, ball 65 is maintained within ball housing 66, as by ball 65 resting against polished rod 44. As seen in FIG. 3, upon polished rod 44 not being disposed within the central bore 63 of the valve housing 60, which can occur if polished rod 44 breaks and travels downwardly through central bore 63 as shown by arrow 80, the ball 65 moves down the ball support surface 72 in the direction of arrow 81 from the ball receiving cavity 68 into the central bore 63 as shown in phantom lines as at 82. Upon polished rod 44 moving downward in the direction as shown by arrows 80, and being disposed below stuffing box 43, stuffing box 43 is thus opened to the atmosphere. Fluids and gases under pressure in the well below tubing head 40 thus seek to escape from the well and travel upwardly, including into valve housing 60. This pressure force acts upon ball 65 when it is in the position shown in phantom lines as at 82, and causes ball 65 to move upwardly in the direction shown by arrows 83 until ball 65 is seated on ball seating surface 64 as illustrated in FIG. 3.

Still with reference to FIG. 3, if the pressure exerted by the fluids and gases in the well below tubing head 40 is not sufficient to act upon ball 65 and cause it to move upwardly in the direction shown by arrows 83, it is still desirable to automatically close off the well from the atmosphere. If the pressure force is not capable of lifting ball 65, in the manner previously described, ball 65 moves downwardly along ball support 72 in the direction shown by arrow 81, and falls downwardly into central bore 63 into the position shown in phantom lines 82, and then falls further downwardly within valve housing 60, to rest upon an additional ball seating surface, or low pressure sealing surface, 85. Ball seating surface 85 preferably is associated with the central bore 63 of the valve housing 60, as by an internal seating surface 85 formed on the interior of valve housing 60. Preferably, the additional ball seating surface 85 is disposed below the means for moving 67 ball 65. If desired, the additional ball seating surface 85 may be provided as an integral portion of central bore 63, or may be a separate ball seating surface, or seating ring, as illustrated for ball seating surface 64. The separate seating ring 86 is held in its desired position within valve housing 60, as by being received within an annular recess 87 formed in a threaded tubular connector 88, which forms part of valve housing 60, and which is threadedly received upon another tubular member 88' which forms the intermediate and lower ends 89 and 62 of valve housing 60.

Still with reference to FIGS. 2 and 3, valve housing 60 and ball housing 66 are preferably formed from tubular stock having conventional threaded connections, but it should be readily apparent to one of ordinary skill in the art that valve housing 60 and ball housing 66 could have other suitable cross-sectional configurations, provided the central bore 63 is capable of having polished rod 44 pass therethrough in the manner previously described and central bore 63 can also accommodate ball 65. The components of safety check valve 50 may be manufactured of any suitable material having the requisite strength and corrosion resistant properties typically required in connection with other equipment used with oil wells. Ball 65 can be manufactured of any suitable steel having the requisite strength and corrosion resistant properties, but other materials may be utilized for ball 65 provided they have the requisite strength and corrosion resistant qualities. Preferably, ball 65 may be a ceramic ball which is used in conventional ball and seat valves.

With reference to FIG. 3, ball housing 66 has an upper surface 90 disposed above the ball support surface 72 and the upper surface 90 is joined to the valve housing 60 at a junction 91, the junction 91 of the valve housing 60 and the upper surface 90 of ball housing 66 having a rounded configuration, as at 92, whereby no sharp edges are present which could damage the ball 65 if it contacts the junction 91 upon upward movement in the direction shown by arrows 83. For example, if there are sufficient pressure forces being exerted upon ball 65 when it is disposed in the position shown by phantom lines 82, ball 65 may not be forced upwardly in the straight line shown by arrows 83, but rather might veer to the right, toward junction 91, as the pressure forces act upon ball 65. The rounded configuration 92 of junction 91 thus serves to minimize the possibility of ball 65 contacting junction 91 or upper surface 90, and having nicks, or indentations, formed in its outer surface which seats with ball seating surface 64.

It is thus seen that upon polished rod 44 ceasing to be disposed within stuffing box 43, which can occur upon the breaking of polished rod 44, safety check valve 50 provides a quick and automatic sealing off of the fluids and gases within the well from the earth's atmosphere.

It is to be understood that the invention is not limited to the exact details of construction, operation, exact materials or embodiments shown and described, as obvious modifications and equivalents will be apparent to one skilled in the art. For example, the ball could be suspended within a ball receiving cavity in a spaced relationship from the interior surface of the ball housing, and a sensor could be provided to release the ball from the ball receiving cavity upon the polished rod not being disposed within the central bore of the valve housing. Accordingly, the invention is therefore to be limited only by the scope of the appended claims.

I claim:

1. A safety check valve, for use with a pumping unit for petroleum fluids, the pumping unit including a polished rod and a stuffing box, comprising:

a valve housing having upper and lower ends and a central bore extending between the upper and lower ends and adapted to have the polished rod pass through the central bore;

a ball seating surface associated with the central bore;

a non-spring biased ball;

a ball housing for the ball and associated with the valve housing; and means for moving the ball from the ball housing into the central bore upon the polished rod not being disposed in the central bore, including a ball receiving cavity associated with the ball housing, the ball housing having first and second ends, the first end of the ball housing being in communication with the central bore of the valve housing, the second end being closed; the ball receiving cavity having a ball support surface upon which the ball may rest, when the ball is disposed in the ball receiving cavity, the ball support surface sloping downwardly toward the first end of the ball housing, whereby if the polished rod is not disposed within the central bore of the valve housing, the ball moves down the ball support surface, under the force of gravity, from the ball receiving cavity into the central bore and seats on the ball seating surface.

2. The safety check valve of claim 1, wherein the ball housing has an upper surface disposed above the ball support surface and the upper surface is joined to the valve housing at a junction, the junction of the valve housing and the ball having upper surface having a rounded configuration, whereby the ball will not be damaged if it contacts the junction.

3. The safety check valve of claim 1, wherein the ball seating surface is disposed above the means for moving the ball.

4. The safety check valve of claim 1, wherein an additional ball seating surface is associated with the central bore of the valve housing and the additional ball seating surface is disposed below the means for moving the ball.

* * * * *

UNITED STATES PATENT AND TRADEMARK OFFICE

CERTIFICATE OF CORRECTION

PATENT NO. : 5,086,802

DATED : February 11, 1992

INVENTOR(S) : Harry L. Spears

It is certified that error appears in the above-identified patent and that said Letters Patent is hereby corrected as shown below:

In Claim 2, line 5, after "ball", delete "having", and insert --housing--.

Signed and Sealed this

Twenty-seventh Day of April, 1993

*Attest:*

*Attesting Officer*

MICHAEL K. KIRK

*Acting Commissioner of Patents and Trademarks*